US007389868B2

(12) United States Patent
Lewand et al.

(10) Patent No.: US 7,389,868 B2
(45) Date of Patent: Jun. 24, 2008

(54) JEWELRY SECURITY ORGANIZATION AND STORAGE DEVICE

(76) Inventors: Ashley C. Lewand, 5810 N. Marmora, Chicago, IL (US) 60646; James Allen Lewand, 5810 N. Marmora, Chicago, IL (US) 60646

( * ) Notice: Subject to any disclaimer, the term of this patent is extended or adjusted under 35 U.S.C. 154(b) by 0 days.

(21) Appl. No.: 10/206,481

(22) Filed: Jul. 26, 2002

(65) Prior Publication Data

US 2004/0016670 A1 Jan. 29, 2004

(51) Int. Cl.
*A45C 11/04* (2006.01)

(52) U.S. Cl. ..... 206/6.1; 206/495; 206/566; 206/806; 211/85.2

(58) Field of Classification Search ..... 206/6.1, 206/566, 806, 493, 483, 284, 285, 289, 298, 206/495; 211/85.2; 312/114, 246, 237
See application file for complete search history.

(56) References Cited

U.S. PATENT DOCUMENTS 4,099,611 A * 7/1978 Feibelman ..... 206/6.1
4,324,446 A * 4/1982 LeSage ..... 206/566
4,401,219 A 8/1983 Mink
4,413,736 A 11/1983 Nibling
4,966,287 A * 10/1990 Snyder ..... 211/85.2
4,967,913 A * 11/1990 Bayer ..... 211/38
5,035,319 A * 7/1991 Kunisch ..... 206/6.1
5,209,344 A 5/1993 Smith
5,246,103 A 9/1993 Hicks
5,253,750 A * 10/1993 Keffer ..... 206/6.1
5,351,813 A * 10/1994 Golovan ..... 206/806
5,427,230 A 6/1995 Mattox
5,511,873 A 4/1996 Mech
5,551,772 A 9/1996 Keffer
5,671,849 A * 9/1997 Bacon ..... 211/85.2
5,931,319 A 8/1999 Murphy
6,161,686 A 12/2000 Simon et al.
6,474,466 B1 * 11/2002 Barahona ..... 206/6.1

* cited by examiner

*Primary Examiner*—Luan K Bui
(74) *Attorney, Agent, or Firm*—Joanne Denison; Virginia Wallace; Denison & Assocs, PC

(57) ABSTRACT

The present invention consists of a jewelry storage and concealment device having rigid frame which is substantially thin and planar and which is suitable for attachment to a standard hanger, over which any ordinary article of clothing may be placed, for concealing the device between clothes in a closet. Or, it may be provided with a mirrored door on its front or a decorative picture and picture frame so that it may be hung on a wall and the device may be obscured from the view of thieves or unauthorized users. The present invention contains a plurality of square or rectangular compartments which are provided with hooks, posts or curtain walls so that the device can easily hold earrings, either pierced or clip on style, bracelets, necklaces, rings, etc. In such a manner, a highly secure jewelry organizing and storage system is shown.

1 Claim, 2 Drawing Sheets

JEWELRY SECURITY ORGANIZATION AND STORAGE DEVICE

FIELD OF THE INVENTION

The present invention relates to the field of jewelry storage and retrieval devices and especially those which are anti-theft in nature and can easily be camouflaged behind a mirror or by placing the device on a hanger, covered by an ordinary article of clothing, between clothes in a closet.

BACKGROUND OF THE INVENTION

Currently, in the prior art, there are available a number of devices which are designed to hold jewelry neatly and securely in a flexible roll up device. For example, U.S. Pat. No. 5,209,344 issued to Smith discloses a device which has a thin flexible planar layer of plastic or fabric to which is attached a plurality of transparent pockets into which jewelry items may be placed. The entire device is intended to be hung from a closet rod or hook which renders the pieces of jewelry stored therein readily visible and available to the user. However, there must be one pocket for each piece of jewelry to be contained therein, which limits the amount of jewelry contained in the device to the number of pockets provided on the device.

Another issued patent, U.S. Pat. No. 5,427,230 issued to Mattox, discloses the use of a similar device, made from a mesh type fabric which is supported by additional segments of solid type fabric. Rings cannot be accommodated by such a device. Further, necklaces and bracelets can only be held by just a few velcro strap attachments located at the bottom of the device.

A similar soft planar jewelry holding device is shown in U.S. Pat. No. 4,401,219 issued to Mink which discloses the use of varying sizes of transparent plastic removably secured to a fabric backing member by means of miniature hook and loop fasteners. During the use of this particular device, the user cannot simply remove the jewelry pieces; she must pull back a portion of the hook/loop fastening member, select the piece, and then reposition the plastic retention member.

A final patent shown in the prior art is U.S. Pat. No. 4,413,736 issued to Nibbling which discloses the use of a jewelry box having a rigid frame member which is fastened onto a rigid, rectangular jewelry box member which contains a pair of screens. It is anticipated that earrings and necklaces shall be attached by separate hook or pin members which are thrust into a backing board in the interior of the device. The device is apparently suited only to holding necklaces, bracelets and rings, and no means for holding earrings, either pierced or clip is provided.

Thus, the prior art does not show any device which is rigid, easy to conceal in a closet between clothes, covered by an ordinary article of clothing, or behind a picture or mirror and which can hold a wide variety of jewelry such as necklaces, bracelets and either pierced or clip style earrings wherein the various jewelry pieces may be readily viewed and selected by the user.

SUMMARY OF THE INVENTION

The present invention consists of a jewelry storage and containment device which may be used between clothes in a closet or behind a mirror or picture frame in order to make theft difficult or impossible. The device consists of a relatively thin, planar frame member having a plurality of shallow chambers designed to hold a wide range of jewelry pieces, including, but not limited to: rings, earrings (pierced or clip on style), necklaces, bracelets, etc. Necklaces, bracelets and rings may be retained by providing a plurality of small hooks or clips at the top of each chamber. Earrings may be retained by providing a screen member secured within a removable frame wherein the earring post of a pierced earring may readily be secured there through. The securement member may comprise magnetic elements, or it may be even be clips or brackets. Or in the case of clip style earrings, a curtain wall may be provided which the clip style earring may be placed upon.

It is anticipated that the device may be made from plastic or other polymer, or it may even be made from wood, and especially a white painted wood framing for an aesthetically pleasing appearance. Or, if desired, the wood utilized in construction even be a select hardwood, such as oak, mahogany or cherry.

It is further anticipated that the device may be secured to any sturdy hanger with hooks, ties, clips, miniature hook and loop strapping, or other common fastening means. In such a manner, the jewelry containment device may be easily hidden by placing an article of clothing over the device within the confines of clothing in a closet where it is unlikely a thief could find the jewelry holder.

Another means by which the jewelry organizer may be hidden from thieves is to conceal it behind a mirror or a picture frame. The mirror may be either plain or made from beveled or etched glass for a decorative effect. The picture frame may either be blank for a personal picture or set of pictures, or it may come with a decorative picture. In any case, since it is anticipated that the jewelry holding device is substantially shallow or thin, it is unlikely that a thief would notice that valuables are hidden behind the mirror or picture fame. In any case, the present invention is eminently suitable for recessing the device within a wall, making it virtually impossible for any person to know it is there without having prior knowledge of its presence.

In such a manner, a highly versatile and secure jewelry holding device is show which is capable of holding necklaces, earrings, rings, bracelets, etc., and to further prevent its detection by thieves by making the device either hidden behind a picture or mirror, or placing it on a standard sturdy hanger and hanging it underneath an article of clothing and placing it between clothes in a closet. As a result, the present invention is easy and simple to use, holds all types of jewelry pieces and is not obvious to any would be thieves.

OBJECTS OF THE INVENTION

Thus, it is one primary object of the present invention to provide a jewelry holder and securement device which is substantially, upright, thin and planar having a plurality of shallow chambers which are eminently suited to hold a wide variety of jewelry items including, but not limited to: earrings, necklaces, bracelets, rings, etc.

It is yet an additional primary object of the present invention to provide a jewelry holder and securement device which is made from a rigid material such as a plastic or other polymer or even wood which can securely contain the jewelry between clothes in a closet so that it is not easily dislodge and lost from the device.

It is yet a further primary object of the present invention to provide a jewelry holder and securement device which is provided with at least one chamber that has a plurality of hooks which are capable of holding rings, bracelets or necklaces.

It is still an additional primary object of the present invention to provide a jewelry holder and securement device which is provided with a screen to which may be attached pierced earrings and which is retained within the device by a frame with magnets, clips or miniature hook/loop fastening means by which it can be easily removed.

Still an additional primary object of the present invention to provide a jewelry holder and securement device which has a back member and/or a front door with a picture and picture frame or a mirror to conceal its valuable contents from thieves.

A further primary object of the present invention to provide a jewelry holder and securement device which may be attached with hooks, velcro strapping or clips to a sturdy hanger, on which an article of clothing can be placed as one would place any article of clothing, so that it is suitable for hanging between clothes in a closet so that the contents of the device may be hidden from thieves or other unauthorized access.

Still an additional primary object of the present invention to provide a jewelry holder and securement device which has shallow chambers and a plurality of posts contained therein for securely retaining rings or circular earrings conveniently and simply.

These and other objects and advantages of the present invention can be readily derived from the following detailed description of the drawings taken in conjunction with the accompanying drawings present herein and should be considered as within the overall scope of the invention.

BRIEF OF THE DRAWINGS

DETAILED DESCRIPTION OF THE DRAWINGS

Figure 1:
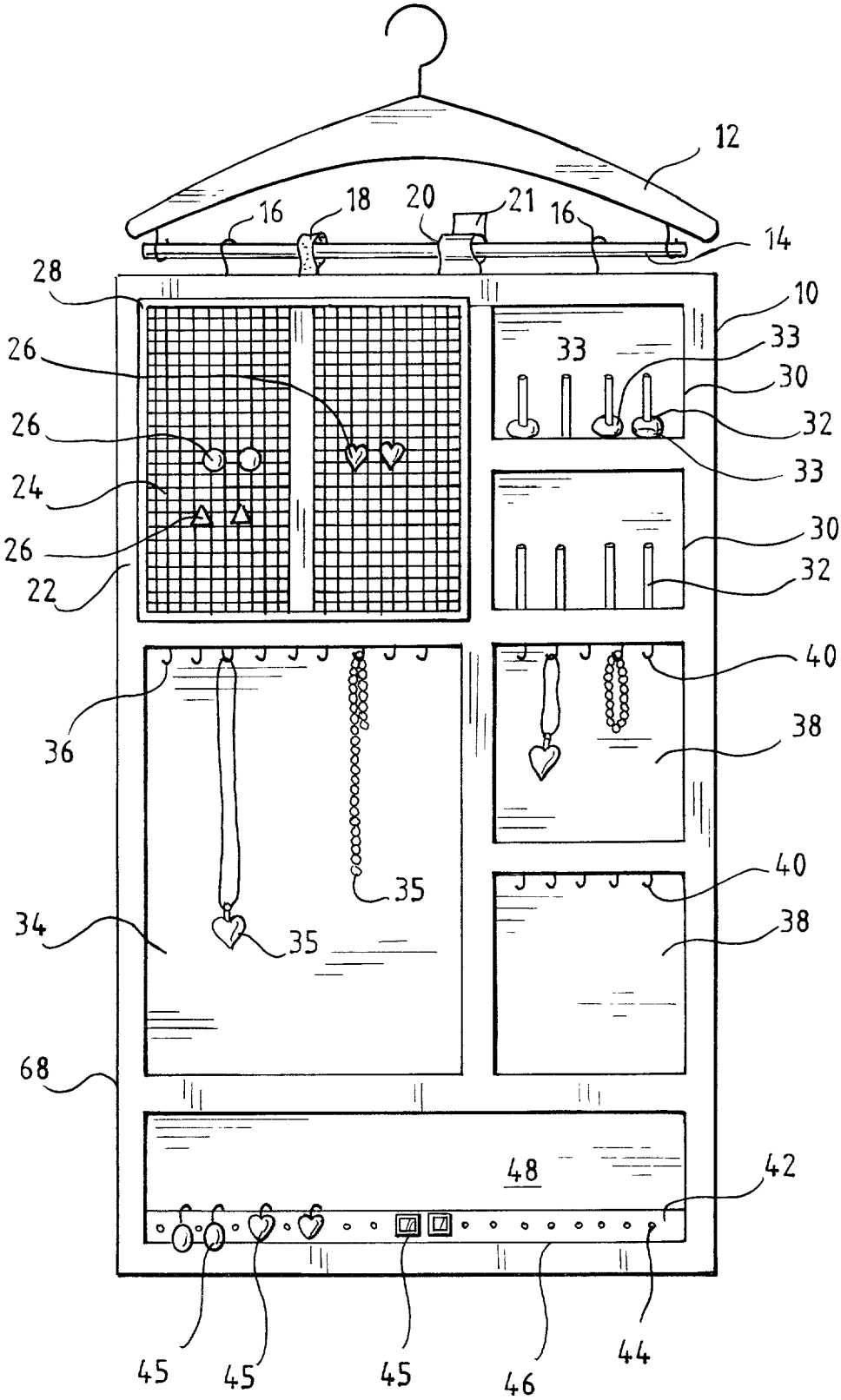
FIG. 1 shows a front elevation view of the present invention showing shallow chambers or recesses suitable for containing earrings, necklaces, rings, bracelets, etc. where this embodiment may be hung from a standard hanger by means of hooks.

Shown now in FIG. 1 is a front elevationol view of jewelry holder 10 which has been secured to hanger 12 and is ready to hang on a rod in a clothes closet or armoire so that the present invention will be difficult or impossible for thieves or unauthorized users to find when covered by an ordinary article of clothing. The jewelry holder 10 has been secured to the hanger 12 by a variety of fastening means readily available in the marketplace and well known in the prior art. For example hooks 16 are provided which simply hang from the pants hanger bar 16, but for a more secure fit, a strap is shown 18 which is made from a piece of Velcro brand fastening strip or any other miniature hook and loop fastening strapping. As an additional means of securely attaching jewelry holder 10 to pants hanger bar 14, a bias spring clamp 20 may be used. This bias spring clamp 20 is provided with a tab or flange 21 which allows the user to firmly open the c-shaped retainment portion of the device to insert pants hanger 14 therethrough.

Although jewelry holder 10 may be made in a wide variety of configurations, its basic design consists of a pierced earring chamber 28 with screening or mesh 24, a ring post chamber with ring posts 32, a necklace chamber 34 with necklace hooks 36, a bracelet chamber 38 with bracelet hooks 40 and a lower shelf 46 with a curtain wall 42 for miscellaneous items. In such a manner, in a singular device, bracelets 39, necklaces 35, clip on 45 and post type 26 earrings and a variety of other types of jewelry and accessories may be safely and conveniently stored. It should be noted that necklace chamber 34 is longer than bracelet chamber 38 because necklaces will require more room to store. Also, a shelf 46 is provided with a curtain wall 42 so that miscellaneous jewelry items that will not fit elsewhere may be stored, such as bangle bracelets, hair clips and hair ties, barrettes and the like may be placed thereupon. Substantially small apertures may be placed in curtain wall 42 so that this may provide even further storage for pierced earrings, although in the present figure, clip on style earrings 45 have been attached thereto.

The frame 68 of jewelry holder 10 may be made from any suitable rigid material such as plastic or other polymer or a plain wood such as pine, but where a more elegant finish is desired, the jewelry holder frame 68 may even be made from oak, cherry or mahogany for a most pleasing appearance. In an instance where pine or other soft wood is utilized in construction it is anticipated that a coating of white point is desirable. In any instance, the jewelry holder 10 is further provided with a bock or rear wall 48 which may be made from the some material as the frame 68, or it may be made from a different material, even fiberboard or a composite board may be desired for economy. The back or rear wall is provided to prevent items of jewelry from being inadvertently dislodged from the jewelry holder 10 and becoming lost or misplaced, especially when it is hung in a clothes closet between items of clothing.

Figure 2:
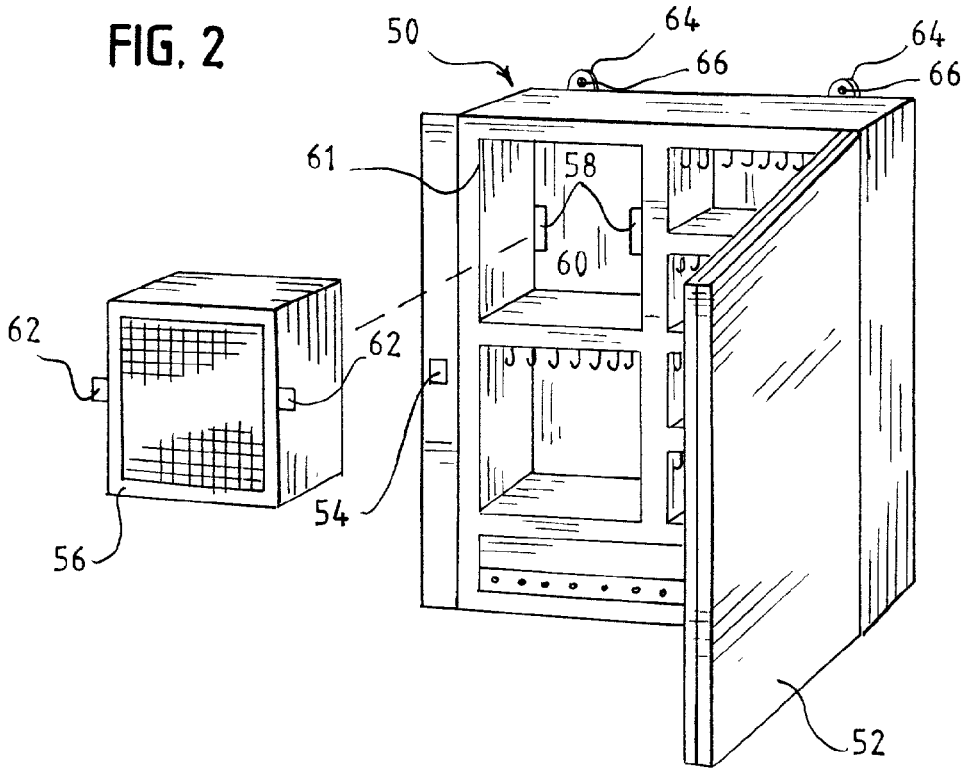
FIG. 2 is a perspective view of the present invention showing a mirrored door embodiment and a blown apart view of a pierced earring screen removed from the device.

FIG. 2 shows a second embodiment of the present invention, mirrored door jewelry holder 50 in which mirrored door 52 is utilized to conceal the portion of the device containing jewelry items. Also shown in the view are the details of how pierced earring screen frame 56 may be held within pierced earring chamber 61. In this instance, pierced earring screen frame 56 has been removed from pierced earring chamber 61 by gripping two fabric tabs 62 located directly on either side of pierced earring screen frame 56. The pierced earring screen frame 56 is held firmly in place by means of two magnets secured to its backside, which magnets are then attached to two corresponding magnetic elements which are located on the rear or back wall 60 of pierced earring chamber 61. In such a manner the pierced earring screen fame 56 may be easily and conveniently removable secured within pierced earring chamber 61.

Also shown in this view is magnetic door latch 54 which secures mirrored door 52 to conceal the jewelry when jewelry holder 10 is not being accessed by the user. Also shown in this view are a pair of small annular screw retainment tabs 64 located at the top of jewelry holder 50 which are used to firmly secure jewelry holder 50 to a wall, preferably to studs located in the wall by means of screws or fastening elements 66. If a small lock is placed on the device (not shown), the it is preferred that non-reversible screws are utilized to prevent unauthorized removal from the wall.

Figure 3:
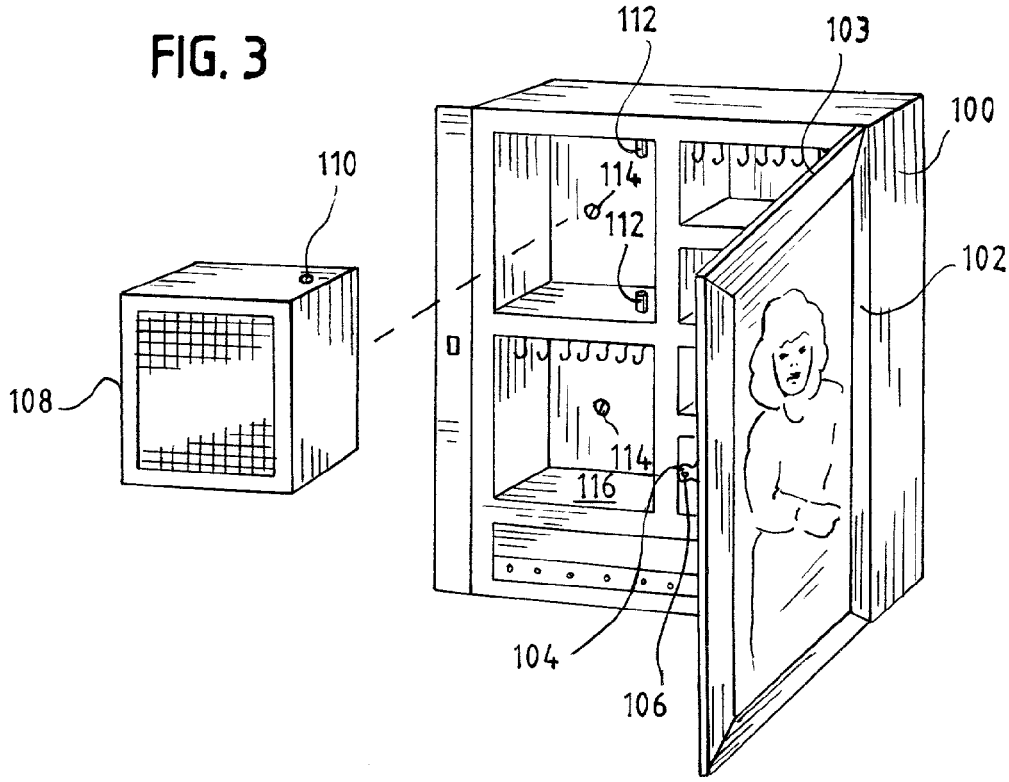
FIG. 3 is a perspective view of the present invention showing a picture frame door embodiment of the present invention and a hinged mechanism for containing a pierced earring screen which has been blown apart from the device to better view the hinge pins and corresponding retaining apertures.

Shown in FIG. 3 is picture frame jewelry holder 100 which has been provided with a hinged door with a picture frame 102. In this particular embodiment, a door with picture frame 102 is hingedly secured to picture frame jewelry holder 100. A recess or opening 103 in the top or side portion of door with picture frame 102 is provided so that the user may slip their own picture or print therewithin in order to removably secure a decorative picture or print to the picture frame jewelry holder. Also shown in this preferred embodiment is a different method for securing pierced earring screen frame 108 to picture frame jewelry holder 100. In this preferred embodiment hinge pins 112 are provided so that they are hingedly secured within corresponding apertures 110 located on pierced earring screen frame.

An additional feature of this preferred embodiment is a locking feature wherein a bias spring door latch 104 is provided with a small aperture 105 therethrough which fits through corresponding slot 107 on the picture frame jewelry holder. When the picture frame jewelry holder 100 is placed in its closed position, a small lock may be passed through aperture 105 on the bias spring door latch 104. The entire unit, picture frame jewelry holder 100 may then be secured to the wall with a plurality of standard fastening elements 114 which are driven through the rear wall of picture frame jewelry holder 100 and preferably into wall studs or another very rigid wall material. Accordingly, the present invention provides superior resistance to discovery by unauthorized users or thieves, and even if found, it is locked and secure from tampering with the contents of the device.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A jewelry holder comprising:

a substantially thin and planar rigid frame containing a plurality of shallow chambers, and, at least one shallow chamber containing a plurality of fastening means for holding items of jewelry, and, a hanger provided with a hanger fastening means for fastening the hanger to the rigid frame, a mesh having a plurality of apertures for removably securing at least one pair of pierced earrings thereto, and, a small frame member for retaining the mesh, and a magnetic means for removably securing the small frame member to the rigid frame.

* * * * *

UNITED STATES PATENT AND TRADEMARK OFFICE

CERTIFICATE OF CORRECTION

PATENT NO. : 7,389,868 B2
APPLICATION NO. : 10/206481
DATED : June 24, 2008
INVENTOR(S) : Ashley C. Lewand and James Allen Lewand It is certified that error appears in the above-identified patent and that said Letters Patent is hereby corrected as shown below:

Column 3, Line 48: "elevationol" should say --elevational--

Signed and Sealed this

Thirtieth Day of September, 2008

JON W. DUDAS
*Director of the United States Patent and Trademark Office*